US006086634A

United States Patent [19]

Smith

[11] Patent Number: 6,086,634

[45] **Date of Patent: *Jul. 11, 2000**

[54] DRY-CLEANING COMPOSITIONS CONTAINING POLYSULFONIC ACID

[75] Inventor: James A. Smith, Chatham, Mass.

[73] Assignee: Custom Cleaner, Inc., Scottsdale, Ariz.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/905,328

[22] Filed: Aug. 4, 1997

Related U.S. Application Data

[63] Continuation-in-part of application No. 08/463,493, Jun. 5, 1995, abandoned, and a continuation-in-part of application No. 08/536,273, Sep. 29, 1995, Pat. No. 5,658,651, and a continuation-in-part of application No. 08/798,764, Feb. 11, 1997, abandoned.

[51] Int. Cl.[7] ..... D06L 1/00; D06L 1/02; D06L 1/08; C11D 17/00

[52] U.S. Cl. ..... 8/142; 8/137; 510/285; 510/287; 510/289; 510/290; 510/291; 510/295; 510/297; 510/283; 510/282; 510/281; 442/59; 383/116; 383/42; 383/63; 383/95; 383/97

[58] Field of Search ..... 8/137, 142; 510/285, 510/287, 289, 290, 291, 295, 297, 283, 282, 281; 442/59; 383/116, 42, 63, 95, 97

[56] References Cited

U.S. PATENT DOCUMENTS

| | | |
|---|---|---|
| Re. 28,969 | 9/1976 | Naito . |
| 375,652 | 12/1887 | Scott . |
| 1,885,133 | 11/1932 | Oppenheimer . |
| 2,102,858 | 12/1937 | Schlumbohm . |
| 2,251,328 | 8/1941 | Ehret . |
| 2,316,386 | 4/1943 | Albrecht . |
| 2,560,649 | 7/1951 | Hornaday . |
| 3,088,158 | 5/1963 | Boyle . |
| 3,151,345 | 10/1964 | Massop . |
| 3,242,109 | 3/1966 | Showalter . |
| 3,323,206 | 6/1967 | Clark . |
| 3,377,249 | 4/1968 | Marco . |
| 3,435,537 | 4/1969 | Rumsey . |
| 3,442,692 | 5/1969 | Gaiser . |
| 3,463,735 | 8/1969 | Stonebraker . |
| 3,579,454 | 5/1971 | Collier . |
| 3,593,544 | 7/1971 | Henderson . |
| 3,632,396 | 1/1972 | Perez-Zamora . |
| 3,637,224 | 1/1972 | Triplett . |
| 3,650,816 | 3/1972 | Rudy . |
| 3,686,125 | 8/1972 | Miller . |
| 3,813,221 | 5/1974 | Stubits . |
| 3,816,321 | 6/1974 | Kleinschmidt . |

(List continued on next page.)

FOREIGN PATENT DOCUMENTS

| | | |
|---|---|---|
| 1017101 | 9/1977 | Canada . |
| 0036833 | 9/1981 | European Pat. Off. . |
| 0213500 | 3/1987 | European Pat. Off. . |
| 0225848 | 6/1987 | European Pat. Off. . |
| 0328174 | 8/1989 | European Pat. Off. . |
| 3344847 | 12/1989 | European Pat. Off. . |
| 0402981 | 12/1990 | European Pat. Off. . |
| 0429172 | 5/1991 | European Pat. Off. . |
| 0498433 | 8/1992 | European Pat. Off. . |
| 0527625 | 2/1993 | European Pat. Off. . |
| 0630965 | 12/1994 | European Pat. Off. . |
| 0738778 A1 | 10/1996 | European Pat. Off. . |
| 2021561 | 11/1970 | Germany . |
| 2460239 | 7/1975 | Germany . |
| 6220431 | 8/1994 | Japan . |
| 9086545 | 3/1997 | Japan . |
| 9086546 | 3/1997 | Japan . |
| 1086846A | 5/1994 | Switzerland . |
| 2302553 | 1/1997 | United Kingdom . |
| 2310796 | 9/1997 | United Kingdom . |
| WO92/17285 | 10/1992 | WIPO . |
| WO 96/ 09233 | 3/1996 | WIPO . |
| WO 96/30471 | 10/1996 | WIPO . |
| WO 96/30472 | 10/1996 | WIPO . |
| WO 96/30580 | 10/1996 | WIPO . |
| WO 96/30581 | 10/1996 | WIPO . |
| WO 96/30583 | 10/1996 | WIPO . |
| WO 96/37652 | 11/1996 | WIPO . |
| WO 97/00738 | 1/1997 | WIPO . |
| WO 97/00939 | 1/1997 | WIPO . |
| WO 97/00990 | 1/1997 | WIPO . |
| WO 97/00991 | 1/1997 | WIPO . |
| WO 97/00992 | 1/1997 | WIPO . |
| WO 97/00993 | 1/1997 | WIPO . |
| WO 97/20098 | 6/1997 | WIPO . |
| WO 97/20099 | 6/1997 | WIPO . |
| WO97/22683 | 6/1997 | WIPO . |
| WO 97/26821 | 7/1997 | WIPO . |
| WO 97/27354 | 7/1997 | WIPO . |
| WO 97/34519 | 9/1997 | WIPO . |
| WO 97/41292 | 11/1997 | WIPO . |

OTHER PUBLICATIONS

Product literature for Rheothik Polysulfonic Acid, "Rheothik Polymer 80–11", Henkel Corporation, Minneapolis MN (Date Unknown).

Takase et al., "High Temperature Characteristics of Nylon–11 and Nylon–7 Piezoelectrics", *Macromolecules*, pp. 1–46 (May 1991) (Office of Naval Research, Technical Report No. 23).

Yoshihiro Ohmiya et al., "Mechanical Properties of an Aromatic Polyamide–imide Composite film reinforced with an Aeromatic Polyamide Fiber Cloth at High Temperature", Journal of Applied Polymer Science, vol. 33, pp. 1601–1607 (1987). (Month Unknown).

*Primary Examiner*—Alan Diamond
*Attorney, Agent, or Firm*—Nash & Titus, LLC

[57] ABSTRACT

This invention relates to dry-cleaning systems which include dry-cleaning compositions which contain polysulfonic acid and water, and a bag for the cleaning and containment of soiled fabric articles. The invention also relates to methods of using the dry-cleaning system and dry-cleaning composition.

42 Claims, No Drawings

FOREIGN PATENT DOCUMENTS

| | | | |
|---|---|---|---|
| 3,826,682 | 7/1974 | Liebowitz . | |
| 3,827,857 | 8/1974 | Boulus . | |
| 3,840,497 | 10/1974 | Gondorchin . | |
| 3,888,766 | 6/1975 | De Young . | |
| 3,890,448 | 6/1975 | Ito . | |
| 3,896,033 | 7/1975 | Grimm . | |
| 3,933,425 | 1/1976 | Grunewalder . | |
| 3,936,538 | 2/1976 | Marshall . | |
| 3,945,936 | 3/1976 | Lucas . | |
| 3,949,137 | 4/1976 | Akrongold . | |
| 3,977,980 | 8/1976 | Fry . | |
| 3,988,499 | 10/1976 | Reynolds . | |
| 3,989,638 | 11/1976 | Bradley . | |
| 3,995,084 | 11/1976 | Berger . | |
| 4,011,172 | 3/1977 | Marsan . | |
| 4,017,411 | 4/1977 | Diehl . | |
| 4,019,023 | 4/1977 | Marzonie . | |
| 4,022,938 | 5/1977 | Zaki . | |
| 4,041,205 | 8/1977 | Compa . | |
| 4,049,858 | 9/1977 | Murphy . | |
| 4,065,422 | 12/1977 | Lundmark . | |
| 4,066,394 | 1/1978 | Leonard . | |
| 4,077,890 | 3/1978 | Barker . | |
| 4,101,711 | 7/1978 | Stillman . | |
| 4,106,214 | 8/1978 | Schmidt . | |
| 4,110,498 | 8/1978 | Benjamin . | |
| 4,118,525 | 10/1978 | Jones . | |
| 4,126,563 | 11/1978 | Barker . | |
| 4,127,515 | 11/1978 | MacRae . | |
| 4,137,200 | 1/1979 | Wood . | |
| 4,142,978 | 3/1979 | Murphy . | |
| 4,170,565 | 10/1979 | Flesher . | |
| 4,188,304 | 2/1980 | Clarke . | |
| 4,214,038 | 7/1980 | McCarty . | |
| 4,231,166 | 11/1980 | McMillan . | |
| 4,236,322 | 12/1980 | Hastings . | |
| 4,239,639 | 12/1980 | Gilbert . | |
| 4,242,377 | 12/1980 | Roberts . | |
| 4,271,272 | 6/1981 | Stickman . | |
| 4,289,815 | 9/1981 | Lee . | |
| 4,336,024 | 6/1982 | Denissenko . | |
| 4,344,930 | 8/1982 | MacRae . | |
| 4,351,754 | 9/1982 | Dupre . | |
| 4,362,638 | 12/1982 | Caskey . | |
| 4,374,035 | 2/1983 | Bossu . | |
| 4,388,332 | 6/1983 | Egee . | |
| 4,412,027 | 10/1983 | Klein . | |
| 4,448,699 | 5/1984 | Barrat . | |
| 4,488,552 | 12/1984 | McCann . | |
| 4,511,495 | 4/1985 | Melville . | |
| 4,514,444 | 4/1985 | Ives . | |
| 4,530,781 | 7/1985 | Gipp . | |
| 4,532,063 | 7/1985 | Gueldenzopf . | |
| 4,534,892 | 8/1985 | Suzuki . | |
| 4,540,510 | 9/1985 | Karl . | |
| 4,548,954 | 10/1985 | Smith . | |
| 4,557,852 | 12/1985 | Schulz . | |
| 4,563,483 | 1/1986 | Smith . | |
| 4,565,644 | 1/1986 | Smith . | |
| 4,566,980 | 1/1986 | Smith . | |
| 4,569,861 | 2/1986 | Smith . | |
| 4,581,287 | 4/1986 | Smith . | |
| 4,581,385 | 4/1986 | Smith . | |
| 4,594,362 | 6/1986 | Smith . | |
| 4,610,904 | 9/1986 | Mahn . | |
| 4,613,446 | 9/1986 | Magyar . | |
| 4,673,523 | 6/1987 | Smith . | |
| 4,704,222 | 11/1987 | Smith | 510/396 |
| 4,740,326 | 4/1988 | Hortel . | |
| 4,749,509 | 6/1988 | Kacher . | |
| 4,749,596 | 6/1988 | Evans . | |
| 4,764,289 | 8/1988 | Trinh . | |
| 4,784,786 | 11/1988 | Smith et al. | 15/104.93 |
| 4,797,221 | 1/1989 | Gueldenzopf . | |
| 4,806,752 | 2/1989 | Kellett . | |
| 4,816,095 | 3/1989 | Taylor . | |
| 4,820,435 | 4/1989 | Zafiroglu . | |
| 4,824,582 | 4/1989 | Nayar . | |
| 4,834,900 | 5/1989 | Soldanski . | |
| 4,839,076 | 6/1989 | Willman . | |
| 4,840,792 | 6/1989 | Joulain . | |
| 4,853,142 | 8/1989 | Win . | |
| 4,855,183 | 8/1989 | Oberle . | |
| 4,856,541 | 8/1989 | Kellett . | |
| 4,889,643 | 12/1989 | Royce . | |
| 4,894,264 | 1/1990 | Akao . | |
| 4,909,962 | 3/1990 | Clark . | |
| 4,917,925 | 4/1990 | Loretti . | |
| 4,938,879 | 7/1990 | Kellett . | |
| 4,946,617 | 8/1990 | Sheridan . | |
| 4,953,739 | 9/1990 | Wooge . | |
| 5,002,075 | 3/1991 | Kellett . | |
| 5,053,157 | 10/1991 | Lloyd . | |
| 5,055,215 | 10/1991 | Mains . | |
| 5,062,973 | 11/1991 | Kellett . | |
| 5,066,413 | 11/1991 | Kellett . | |
| 5,077,119 | 12/1991 | Wraige . | |
| 5,082,466 | 1/1992 | Rubenstein . | |
| 5,108,660 | 4/1992 | Michael . | |
| 5,145,595 | 9/1992 | Morris . | |
| 5,173,200 | 12/1992 | Kellett . | |
| 5,196,132 | 3/1993 | Mains . | |
| 5,208,074 | 5/1993 | Kosal . | |
| 5,215,795 | 6/1993 | Matsumoto . | |
| 5,238,587 | 8/1993 | Smith et al. | 510/277 |
| 5,261,426 | 11/1993 | Kellett . | |
| 5,296,291 | 3/1994 | Mueller . | |
| 5,415,904 | 5/1995 | Takubo . | |
| 5,419,848 | 5/1995 | VanEenam | 510/365 |
| 5,444,924 | 8/1995 | Joslin . | |
| 5,449,763 | 9/1995 | Wulff . | |
| 5,454,982 | 10/1995 | Murch . | |
| 5,454,983 | 10/1995 | Michael . | |
| 5,460,864 | 10/1995 | Heitkamp . | |
| 5,488,157 | 1/1996 | Bjorkquist . | |
| 5,516,459 | 5/1996 | VanEenam | 510/365 |
| 5,547,476 | 8/1996 | Siklosi . | |
| 5,591,236 | 1/1997 | Roetker . | |
| 5,603,284 | 2/1997 | Freedman . | |
| 5,612,105 | 3/1997 | Okamoto . | |
| 5,630,847 | 5/1997 | Roetker . | |
| 5,630,848 | 5/1997 | Young . | |
| 5,632,780 | 5/1997 | Siklosi . | |
| 5,648,326 | 7/1997 | Sramek . | |
| 5,658,625 | 8/1997 | Bradfute . | |
| 5,658,651 | 8/1997 | Smith et al. | 442/59 |
| 5,681,355 | 10/1997 | Davis . | |
| 5,687,591 | 11/1997 | Siklosi . | |
| 5,746,776 | 5/1998 | Smith et al. | 8/142 |

DRY-CLEANING COMPOSITIONS CONTAINING POLYSULFONIC ACID

This application is a continuation-in-part of U.S. Ser. No. 08/463,493, filed Jun. 5, 1995, now abandoned, and is a continuation-in-part of U.S. Ser. No. 08/536,273, filed Sep. 29, 1995, now U.S. Pat. No. 5,658,651, and is a continuation-in-part of U.S. Ser. No. 08/798,764, filed Feb. 11, 1997, now abandoned, and the entire contents of these applications are incorporated herein by reference.

FIELD OF THE INVENTION

The present invention relates to dry-cleaning systems utilizing polysulfonic acid, by which fabric articles can be freshened or dry-cleaned in a dryer, such as a rotary clothes dryer. The invention includes such dry-cleaning compositions and bags having an opening with a fastening system that enables closure of the bag in a vapor impermeable manner. The invention also contemplates kits containing the dry-cleaning compositions and the bags, as well as methods for using the dry-cleaning systems.

BACKGROUND OF THE INVENTION

Methods for dry-cleaning fabrics commonly employ organic solvents which can readily dissolve or disperse soils such as water-insoluble substances, including greases, oily dirts and the like, and which exhibit low solvent boiling points, enabling easy recovery of the solvents.

The use of solvent-based dry-cleaning methods has, however, been primarily limited to commercial cleaning operations which employ expensive specialized equipment. Such equipment includes stills with condensers to contain vapors from the cleaning solvents, which are often toxic. As a result, to utilize such dry-cleaning processes, particularly to remove water-insoluble spots and/or stains from clothes, the user must bring the clothes to a specialized dry-cleaning establishment and pick up the cleaned clothes at a later date. This results in inconvenient expenditures of time in going to the dry-cleaner, waiting for the clothes to be properly cleaned, picking up the clothes, and dealing with damaged and lost articles of clothing. Moreover, articles of clothing from many different people are dry-cleaned with the same batch of solvent, which can result in malodorous residues.

The conventional methods for dry-cleaning utilize chlorinated hydrocarbon solvents, such as perchloroethylene, which are generally charged with water and detergent. A disadvantage of these dry-cleaning systems is that these solvents, and especially perchloroethylene, do not function effectively with high amounts of water. Also, such solvents in general are undesirable components in dry-cleaning systems because of their environmental toxicity.

It is therefore an object of the invention to provide a dry-cleaning composition that does not include solvents like perchloroethylene or other undesirable hydrocarbon solvents, such as those used commercially.

It is an object of the invention to provide a dry-cleaning composition that contains polysulfonic acid as an essential ingredient.

It is an object of the invention to provide a dry-cleaning composition that contains polysulfonic acid in admixture with other solvents.

It is an object of the invention to provide a dry-cleaning composition suitable for use in dry-cleaning of all fabrics, including wool, leather, nylon, cotton, polyester, etc. as well as delicate fabrics such as 100% acetate, silk, and rayon, and blends of these fabrics.

It is an object of the invention to provide a dry-cleaning composition that improves the slip characteristics to fabrics (e.g., reduction in drag).

It is an object of the invention to provide methods of use therefor which can be conducted at home without having to take soiled or stale-smelling clothes to commercial cleaning establishments and incurring such inconveniences and disadvantages mentioned above. It is noted that a process for home dry-cleaning clothing is disclosed by S. Denissenko et al. in U.S. Pat. No. 4,336,024, wherein the soiled areas are pre-treated with a liquid cleaning composition. The clothing is then attached to an absorbent sheet and spun using the spin cycle of a washing machine, so that the cleaning composition and the soil are driven through the clothing and into the absorbent sheet. It is also disclosed that the absorbent sheet can be integrally sealed onto a plastic sheet, so that the clothing can be enclosed by the sheet while it is spun in a washing machine. Also, U.S. Pat. No. 5,238,587 issued to J. Smith et al., discloses a method for cleaning soiled fabric via the enclosure of the desired clothing in a bag with an added sheet impregnated with a gelled liquid cleaning composition. (The entire contents of U.S. Pat. No. 4,336,024 and U.S. Pat. No. 5,238,587 are incorporated herein by reference.) Additional objects of the present invention will become readily apparent to persons skilled in the art from the following discussion.

SUMMARY OF THE INVENTION

The present invention provides dry-cleaning or fabric-freshening systems adapted for dry-cleaning and/or freshening all types of fabric articles.

In this invention, the system uses an effective amount of a dry-cleaning composition comprising polysulfonic acid, and water.

The polysulfonic acid should be present in an amount effective to clean and/or freshen a soiled fabric article contacted therewith (preferably between about 0.25 and about 20 weight percent, and more preferably between about 1 and 5 weight percent, based on the total weight percent of the composition). The polysulfonic acid can also be useful to promote the distribution of the dry-cleaning composition on fabric articles while leaving no significant undesirable visible residue on the fabric article.

Preferably, the water is present in an effective amount to disperse the polysulfonic acid and build viscosity (preferably between about 10 and about 99.75 weight percent water, and more preferably between about 20 and about 95 weight percent water, and even more preferably between about 80 and about 95 weight percent water, based on the total weight percent of the composition). However, water levels can be less than 10 weight percent, as long as the polysulfonic acid is dispersed. Water can also be useful as a cleaning solvent in this invention.

The above-described dry-cleaning compositions may further include other components that do not interfere with the dry-cleaning activity of the compositions. For instance, the composition can also contain at least 1 water-miscible or partially water-miscible organic solvent. If present, the amount of organic solvent should be between about 1 and about 85 total weight percent based on the total weight percent of the composition, although total amounts may vary as desired and depending on the presence of other components, as described below, as would be understood by someone of ordinary skill in this art.

Further, the compositions may include surfactants, which if present are preferably in an amount between about 0.01 and about 10 weight percent, based on the total weight percent of the composition, although total amounts may vary as desired and depending on the presence of other components, as described below, as would be understood by someone of ordinary skill in this art. Along these lines, it is known that detergency is better with lower levels of surfactant.

The above-described dry-cleaning compositions may further include gelling agents or viscosity modifiers, gum arabic, karaya gum, gum tragacanth, starch (corn, potato, tapioca, wheat, waxy maize), polyvinyl acetate, PVP/VP combinations, carylics, modified acrylics, xanthan gum, alginates and derivatives of alginates, locust bean gum, animal glue, nonionic cellulose derivatives, nonionic guar derivatives, nonionic starch derivatives, anionic cellulose derivatives, anionic guar derivatives, anionic starch derivatives, casein, carrageenan and guar gum. In addition, the above-described dry-cleaning compositions may further include fragrances, fabric-softening agents, leather-treating agents or other desired agents.

The above-described dry-cleaning compositions may be present on a substrate (for instance, a sheet, a sponge, a dauber, a stick, granules or a cube). A sheet is the preferred substrate, such as, for instance, a plastic sheet or a porous sheet, and the dry-cleaning composition may be stably impregnated onto the sheet. Advantageously, the dry-cleaning compositions of this invention remain in a moist or wet state when present on a substrate. In the alternative, the dry-cleaning compositions may be present in a spray or roll on solution, or the like.

The invention also relates to the above-described dry-cleaning systems which further include a bag that has an opening comprising a fastening system so that the bag can enclose the soiled fabric article in an effective vapor impermeable manner. One option with this form of the invention, instead of or in addition to placing into the bag an effective amount of the dry-cleaning composition, is that the bag has an interior surface, and at least a portion of the interior surface has an effective amount of the dry-cleaning composition releasably absorbed thereinto, wherein the bag is formed of a flexible non-porous material which is not substantially damaged upon exposure to agitation and to a temperature effective to cause the release of the dry-cleaning composition from the interior surface.

The invention also relates to processes for cleaning or freshening a soiled fabric article with the above-described dry-cleaning systems. Such processes comprise the steps of (a) placing into a bag the soiled fabric article and an effective amount of the above-described dry-cleaning composition, wherein the bag includes an opening comprising a fastening system so that the bag can enclose the soiled fabric article in an effective vapor impermeable manner;

(b) closing the fastening system to form the bag into an effective closed system comprising the soiled fabric article and the dry-cleaning composition;

(c) tumbling the closed system in a rotary clothes dryer at an elevated temperature, so that the dry-cleaning composition contacts the soiled fabric article so as to effectively disperse the soil; and (d) opening the fastening system and removing the cleaned or freshened fabric article from the bag.

The invention also relates to methods for removing a stain from a soiled fabric article with the above-described dry-cleaning systems. Such methods comprise the steps of (a) placing into a bag the soiled fabric article and an effective amount of the above-described dry-cleaning composition, wherein the bag includes an opening comprising a fastening system so that the bag can enclose the soiled fabric article in an effective vapor impermeable manner;

(b) closing the fastening system to form the bag into an effective closed system comprising the soiled fabric article and the dry-cleaning composition;

(c) tumbling the closed system in a rotary clothes dryer at an elevated temperature, so that the dry-cleaning composition contacts the soiled fabric article so as to effectively disperse the stain; and (d) opening the fastening system and removing the cleaned fabric article from the bag. If desired, prior to step (a), an amount of the dry-cleaning composition may be applied to the soiled fabric article to loosen the stain (for instance, by rubbing or dabbing the soiled fabric article with the dry-cleaning composition, or by spraying, rolling on or dipping the soiled fabric article with the dry cleaning composition).

The invention also relates to kits for dry-cleaning or fabric-freshening a fabric article. These kits comprise, packaged in association, (i) an effective amount of the above-described dry-cleaning composition, and (ii) a bag including an opening comprising a fastening system so that the bag can enclose the soiled fabric article in an effective vapor impermeable manner. The bag may include an interior surface such as is described above, wherein at least a portion of the interior surface has an effective amount of the dry-cleaning composition releasably absorbed thereinto.

The present invention, including the above-described embodiments and preferred versions thereof is more fully described in the following detailed discussion, wherein all percentages are by weight of the total cleaning composition, unless otherwise noted.

DETAILED DESCRIPTION OF THE INVENTION

As discussed above, the present invention provides dry-cleaning or freshening systems for dry-cleaning or freshening fabric articles, comprising a dry-cleaning composition including polysulfonic acid and water.

The term "fabrics" or "fabric articles" encompasses not only clothing, but other items which are commonly dry-cleaned, including sheets, draperies, rugs, upholstery coverings, towels and the like. For this invention, the term "fabrics" also can include all known fabrics, including wool, leather, nylon, cotton, polyester, etc., as well as delicate fabrics, such as 100% acetate, silk, rayon, and blends of these fabrics.

As used herein, the term "dryer" refers to a rotary hot air dryer, which tumbles the clothes in a drum with warm or heated air at an elevated temperature, usually at a temperature of about 40 and about 95° C., preferably at about 50 and about 90° C., for preselected periods of time (preferably, between about 15 and about 45 minutes).

As used herein with respect to the fabrics to be dry-cleaned or freshened, the term "soil" includes odoriferous compounds such as tobacco smoke, residue, perfume, mustiness, perspiration and the like, as well as visible spots and stains.

Therefore, as used herein, the term "freshen" includes the removal, deodorizing, chemical neutralizing and/or masking of odoriferous compounds on or within a fabric with a desirable scent. As used herein, the term "dry cleaning" or "cleaning" includes the removal, displacement or loosening of one or both kinds of "soil" from the fabric.

In the practice of the present invention, an effective amount of the above-described the dry-cleaning composition is contacted with the soiled fabric (or fabrics). The composition contacts spotted and/or stained portions of fabric therein and removes or decreases the spots and/or stains. In addition to, or in the alternative, the composition contacts the fabric and freshens it.

The compositions of this invention work most effectively when subjected to heat. Therefore, in the preferred practice of the invention, the soiled fabric (or fabrics) is put into a bag along with an effective amount of the above-described dry-cleaning composition, and the bag is subjected to an amount of agitation and heat effective to release the dry-cleaning composition in liquid and/or in vaporous form from the substrate, vehicle, fabric, interior absorptive surface of the bag, etc., on which the dry-cleaning composition is present in the bag. The composition in liquid and/or vaporous form contacts the fabric article and cleans it. Moreover, the composition contacts spotted and/or stained portions of fabric therein and removes or decreases the spots and/or stains. In addition to, or in the alternative, the composition contacts the fabric and freshens it.

In a preferred aspect of the invention, the bag of the present invention may be placed in a rotary hot air clothes dryer to provide the effective amount of heat and agitation, or tumbling. Thus, the present invention provides a method for cleaning and/or freshening soiled fabric articles comprising (a) placing a soiled fabric article (i.e., spotted, stained and/or in need of freshening) in the aforesaid dry-cleaning bag; (b) sealing the bag; and (c) tumbling the sealed bag and its contents in a dryer at a temperature effective to release the dry-cleaning composition in liquid and/or vapor form and for a time effective to contact an effective amount of the released dry-cleaning composition with the soiled fabric, so as to clean and/or freshen the fabric.

A. Polysulfonic Acid and Water

All of the embodiments of the present dry-cleaning compositions contemplate polysulfonic acid as a critical component.

Polysulfonic acid is a polymer which is 17% active in water and has a high viscosity (more than about 20,000 cps). It has been determined that polysulfonic acid affords special advantages when present in the dry-cleaning compositions described herein. For instance, polysulfonic acid acts as a surfactant and exhibits stain removal properties, adds slip characteristics to fabrics (e.g., reduction in drag), and helps dissolve/disperse the other components of the composition onto the fabric without leaving a white residue. Polysulfonic acid acts as a coupling agent to facilitate higher amounts of solvent into the system. Unlike the chlorinated hydrocarbon solvents used conventionally, in this invention polysulfonic acid functions with significant or even high amounts of water. With polysulfonic acid, it is possible to include at least a low amounts of solids in the composition while retaining a relatively high viscosity, which allows for controlling the volatility of the active ingredients in the composition (for instance, allowing controlled release of the ingredients). Further, the pH of the composition including polysulfonic acid may be adjusted without affecting viscosity. Thus, the pH can be appropriately adjusted as needed for particular textiles.

Polysulfonic acid is commercially available from, for example, Henkel under the name HSP-1180 or Rheothik 80-11.

Water is necessary as a carrier in this invention and to disperse the polysulfonic acid and build sufficient viscosity with it. The presence of the water is also useful to enhance the cleaning and other beneficial properties of the polysulfonic acid and, if added, surfactants. Another advantage of the presence of water is that it helps suppress the flash point of the organic solvent, if added, and therefore makes the dry-cleaning systems safer for general use.

B. Organic Solvents

In all the embodiments of the present invention, the dry-cleaning compositions may further include organic solvents. The organic solvent should be water-miscible, or at least partially water-miscible. As would be understood by someone skilled in this art, the less water that is present in the composition, the lower the polarity of the organic solvent is preferred.

Preferably, the major portion of the organic solvent can be a glycol ether. These materials are lower(alkoxy)- or lower (alkoxy)lower(alkoxy)-ethers of ethanol or isopropanol. Some examples of preferred glycol ethers are available under the trade names Arcosolv® (Arco Chemical Co.) or Cellosolve®, Carbitol®, or Propasol® (Union Carbide Corp.), and include, e.g., butylCarbitol®, hexylCarbitol®, methylCarbitol®, and Carbitol® itself, (2-(2-ethoxy) ethoxy)ethanol.

The more preferred organic solvents include dipropylene glycol n-propyl ether, dipropylene glycol n-butyl ether, tripropylene glycol methyl ether, 3-methoxy-3-methyl-1-butanol and γ-butyrolactone. Certain of these solvents, including 3-methoxy-3-methyl-1-butanol and γ-butyrolactone, are preferably used in combination with at least one other solvent. When γ-butyrolactone is the solvent used it is preferably used in small amounts and mixed with another organic solvent.

Other glycol ethers useful in the invention include diethylene glycol monobutyl ether, triethylene glycol monobutyl ether, ethylene glycol monohexyl ether, diethylene glycol monohexyl ether, dipropylene glycol monobutyl ether, butylethoxypropylene glycol, diethylene glycol monomethyl ether, triethylene glycol monomethyl ether, diethylene glycol monoethyl ether, triethylene glycol monoethyl ether, ethylene glycol monopropyl ether, diethylene glycol monopropyl ether, ethylene glycol monobutyl ether, propylene glycol monomethyl ether, dipropylene glycol monomethyl ether, propylene glycol monopropyl ether, propylene glycol monobutyl ether, propylene glycol methyl ether, propylene glycol ethyl ether, propylene glycol n-propyl ether, propylene glycol t-butyl ether, propylene glycol n-butyl ether, dipropylene glycol methyl ether, dipropylene glycol t-butyl ether, dripropylene glycol n-butyl ether, ethylene glycol methyl ether, ethylene glycol ethyl ether, ethylene glycol propyl ether, ethylene glycol butyl ether, ethylene glycol hexyl ether, ethylene glycol ethyl hexyl ether, diethylene glycol methyl ether, diethylene glycol ethyl ether, diethylene glycol propyl ether, diethylene glycol butyl ether, tripropylene glycol n-butyl ether, propylene glycol phenyl ether, propylene glycol n-phenyl ether, ethylene glycol n-butyl ether, diethylene glycol n-butyl ether, triethylene glycol butyl ether, triethylene glycol methyl ether, ethylene glycol phenyl ether, aromatic-based glycol ethers, 1,2-octanediol, 2-methyl-2,4-pentanediol, and MP-diol glycol, and mixtures thereof. Such glycol ethers are commercially available, for instance, from Dow, Union Carbide and Arco. Of course, the choice of glycol ether can be readily made by one of ordinary skill in the art on the basis of its volatility, wt-% of the total dispersion and the like.

Other useful organic solvents include lactones, for instance, dimethyl isosorbide (made by ICI, under the name of Arlasolve DMI).

It is noted that certain solvents are probably not useful because these solvents can dissolve or stain 100% acetate fabrics. Such solvents include N-methyl-2-pyrrolidone, butralactone, methoxytriglycol, and propylene carbonate.

Alcohols which can be employed as co-solvents include liquid polyethylene glycols, i.e., polyethylene glycol-200, 300, 400 or 600, wherein the suffixed numbers indicate the approximate molecular weight of the glycol. Other useful co-solvents include other alcohols, for example, $C_2$–$C_4$ polyols, such as a diol or triol, e.g., ethylene glycol, propylene glyol, glycerol or mixtures thereof.

Other organic solvents can also be used in addition to the at least one organic solvent required in the compositions of the invention, including conventional chlorinated dry-cleaning solvents. Preferred examples of these solvents comprise the di- to tetrachlorinated derivatives of methane, the di- to pentachlorinated derivatives of ethane and of ethylene, the mono- to trichlorinated derivatives of cyclohexane, and monochlorobenzene. Specific examples of this type include carbon tetrachloride, methylenechloride, 1,1-dichloroethane, 1,2-dichloroethane, 1,1-trichloroethane, 1,1,2-trichloroethane, 1,1,1-trichloroethane, 1,1,2-trichloroethane, trichloroethylene, 1,1,2,2-tetrachloroethane, tetrachloroethylene, pentachloroethane, monochlorocyclohexane, 1,4-dichlorocyclohexane, monochlorobenzene and mixtures of the foregoing. Further, hydrocarbon solvents such as isoparaffinic solvents (available commercially as Isopar K and DP-2000) can be useful.

C. Surfactants

In all of the embodiments of the invention, the above-described dry-cleaning compositions may further include surfactants. The surfactants may act as cleaning intensifiers to facilitate removal of the soil upon release of the dry-cleaning composition, especially in the heat of the dryer. Surfactants are generally useful in the dry-cleaning compositions in amounts from about 0.1 to about 20 weight percent, although amounts may vary according to the particular surfactant(s) employed and the desired result, as would be understood by someone skilled in this art.

Non-ionic surfactants and amphoteric surfactants are preferred for use in the dry-cleaning composition and can also act as adjunct fabric softeners. Minor but effective amounts of certain anionic surfactants may also be useful to provide faster dissipation of the composition in the dryer.

Nonionic surfactants contemplated by the invention include the condensation products of ethylene oxide with a hydrophobic polyoxyalkylene base formed by the condensation of propylene oxide with propylene glycol. The hydrophobic portion of these compounds has a molecular weight sufficiently high so as to render it water-insoluble. Where appropriate, the addition of polyoxyethylene moieties to this hydrophobic portion increases the water-solubility of the molecule as a whole, and the liquid character of the product is retained up to the point where the polyoxyethylene content is about 50% of the total weight of the condensation product. Examples of compounds of this type include certain of the commercially-available Pluronic® surfactants (BASF Wyandotte Corp.), especially those in which the polyoxypropylene ether has a molecular weight of about 1500–3000 and the polyoxyethylene content is about 35–55% of the molecule by weight, i.e., Pluronic® L-62.

Preferred nonionic surfactants include the condensation products of $C_8$–$C_{22}$ alkyl alcohols with 2–50 moles of ethylene oxide per mole of alcohol. Examples of compounds of this type include the condensation products of $C_{11}$–$C_{15}$ fatty alcohols with 3–50 moles of ethylene oxide per mole of alcohol which are commercially available from Shell Chemical Co., Houston, Tex., as, i.e., Neodol® 23-6.5 ($C_{12}$–$C_{13}$ fatty alcohol condensed with about 7 moles of ethylene oxide), the PolyTergent® SLF series from Olin Chemicals or the Tergitol® series from Union Carbide, i.e., Tergitol® 15-S-15, which is formed by condensing about 15 moles of ethylene oxide with a $C_{11}$–$C_{15}$ secondary alkanol; Tergitol® TMN-6, which is the condensation product of about 6 moles of ethylene oxide with isolauryl alcohol (CTFA name: isolaureth-6); Incropol® CS-12, which is a mixture of stearyl and cetyl alcohol condensed with about 12 moles of ethylene oxide (Croda, Inc.); Incropol® L-7, which is lauryl alcohol condensed with about 7 moles of ethylene oxide (Croda, Inc.); and Tergitol® 15-S-3, which is the condensation product of about 3 moles of ethylene oxide with a mixture of ($C_{11}$–$C_{15}$) secondary alcohols.

Preferred nonionic surfactants also include ($C_8$–$C_{24}$) fatty acid amides, e.g., the monoamides of a mixture of arachidic and behenic acid (Kenamide® B, Humko Chem. Co., Memphis, Tenn.), and the mono- or di-alkanolamides of ($C_8$–$C_{22}$) fatty acids, e.g., the diethanol amide, monoethanol amide or monoisopropanolamide of coconut, lauric, myristic or stearic acid, or mixtures thereof. For example, Monamidet® S is the monoethanol amide of stearic acid (Mona Industries, Inc., Patterson, N.J.), and Monamine ALX-100S (Mona Industries), is a mixture of the diethanol amide of cocoa fatty acid and the diethanol amide of dodecylbenzene sulfonic acid. The fatty alkanolamide designated "Active #2" (Blew Chem. Co.) is also believed to be of this class of nonionic surfactant.

Other nonionic surfactants which may be employed include the ethylene oxide esters of $C_6$–$C_{12}$ alkyl phenols such as (nonylphenoxy)polyoxyethylene ether. Particularly useful are the esters prepared by condensing about 8–12 moles of ethylene oxide with nonylphenol, i.e., the Igepal® CO series (Rhone-Poulenc, Cranbury, N.J.).

Other useful nonionics include the ethylene oxide esters of alkyl mercaptans such as dodecyl mercaptan polyoxyethylene thioether, the ethylene oxide esters of fatty acids such as the lauric ester of polyethylene glycol and the lauric ester of methoxypolyethylene glycol, the ethylene oxide ethers of fatty acid amides, the condensation products of ethylene oxide with partial fatty acid esters of sorbitol such as the lauric ester of sorbitan polyethylene glycol ether, and other similar materials, wherein the mole ratio of ethylene oxide to the acid, phenol, arnide or alcohol is about 5–50:1.

Useful amphoteric surfactants include the ($C_8$–$C_{22}$) alkyl (dimethyl)amine oxides, such as those of the Schercamox® series (Scher Chem. Co., Clifton, N.J.), e.g., Schercamox DML is lauryl(dimethyl)amine oxide. Other useful amphoteric surfactants are known to the art, e.g., as disclosed in Marshall et al. U.S. Pat. No. 3,936,538), the disclosure of which is incorporated by reference herein.

Anionic surfactants suitable for use in the dry-cleaning composition are well known to those of skill in the art, and include, for example, sodium cocoyl isethionate, commercially available as Jordapon®CI from Mazer Chemicals, Gurnee, Ill. The anionic surfactant may be optionally added in minor but effective amounts e.g., up to about 1%, in addition to the nonionic or amphoteric surfactant.

One broad class of cationic surfactants suitable for use in the dry-cleaning compositions is referred to as quaternary amines, or "quats." These materials not only function to facilitate soil removal, but can also function to condition the fabrics and to reduce static cling and lint adherence. Subclasses of these materials are well known to those of skill in the art and include the monomethyl trialkyl quaternaries, imidazolinium quaternaries, dimethyl alkyl benzyl quaternaries, dialkyl dimethyl quaternaries, methyl dialkoxy alkyl quaternaries, diamido amine-based quaternaries and dialkyl methyl benzyl quaternaries preferably the "alkyl" moiety of these compounds is a ($C_8$–$C_{24}$) alkyl group and the quaternary(amine) is a chloride or methosulfate salt.

It is sometimes preferable, for convenience, to define the subclasses of aliphatic quaternary amines suitable for use in the dry-cleaning compositions structurally. For example, one useful subclass of aliphatic quaternary amines may be structurally defined as follows:

$$(R)(R_1)(R_2)(R_3)N+X—$$

wherein R is benzyl, or lower(alkyl) benzyl; $R_1$ is alkyl of 10 to 24, preferably 12 to 72 carbon atoms; $R_2$ is $C_{10}$–$C_{24}$-alky, $C_1$–$C_4$-alkyl, or ($C_2$–$C_3$)hydroxyalkyl, $R_3$ is $C_1$–$C_4$-alkyl or ($C_2$–$C_3$)hydroxyalkyl and X represents an anion capable of imparting water solubility or dispersibility including chloride, bromide, iodide, sulfate and methosulfate. Particularly preferred species of these aliphatic quats include n-$C_{12}$–$C_{18}$-alkyl-dimethylbenzylammonium chloride (myrisalkonium chloride), n-$C_{12}$–$C_{14}$-alkyldimethyl (ethylbenzyl) ammonium chloride (quaternium 14), dimethyl-(benzyl)ammonium chloride and mixtures thereof. These compounds are commercially available as, for instance, Variquat® B-343 from Sherex Chem. Co., Dublin, Ohio which is a dihydrogenated tallow methyl benzyl ammonium chloride. This class of quat is germicidal, and is preferably used in combination with at least one of the other quats disclosed hereinbelow.

Other useful aliphatic quats include those wherein both R and $R_1$ are ($C_8$–$C_{24}$)alkyl, e.g., the N,N-di-(higher)-$C_{10}$–$C_{24}$-alkyl-N,N-di(lower)-$C_1$–$C_4$ (alkyl)quaternary ammonium salts such as distearyl(dimethyl)ammonium chloride, di-hydrogenated tallow(dimethyl)ammonium chloride, ditallow(dimethyl)ammonium chloride (Arquad® 2HT-75, Akzo Chemie, McCook, Ill.), distearyl (dimethyl) ammonium methylsulfate and di-hydrogenated-tallow (dimethyl)ammonium methyl sulfate (Varisoft® 137, Sherex).

Other useful quaternary ammonium antistatic agents include the acid salts of (higher(alkyl)-amido(lower)alkyl)-(dialkyl)-amines of the general formula:

$$[(A(C{=}0)—Y—)—N(R_1)(R_2)(R_3)]+X—$$

wherein A is a $C_{14}$–$C_{24}$ normal or branched alkyl group, Y is ethylene, propylene or butylene, $R_1$ and $R_2$ are individually H, $C_1$–$C_4$(lower)alkyl or ($C_1$–$C_3$)hydroxyalkyl or together form the moiety —$CH_2$—$CH_2$Y$CH_2$—$CH_2$—, wherein Y is NH, O or $CH_2$; $R_3$ is the same as $R_1$ or is also [A(C=0)Y—], and X is the salt of an organic acid. Compounds of this class are commercially available from Croda, Inc., New York, N.Y., as the Incromate® series, e.g., Incromate® IDL [isostearamidopropyl(dimethyl)amine lactate], Incromate® ISML [isostearamidopropy (morpholinium) lactate] and Incromate® CDP [cocamidopropyl(dimethyl) amine propionate], or as Incrosoft® T-75 [Ditallowdiamido methosulfate (quaternium 53)].

Examples of preferred imidazolinium quaternaries include, but are not limited to, (methyl-1-tallow-amido) ethyl-2-tallow imidazolinium methyl sulfate, available commercially from Sherex Chemical Co. as Varisoft® 475; (methyl-1-oleylamido)ethyl-2-oleyl-imidazolinium methyl sulfate, available commercially from Sherex Chemical Co. as Varisoft® 3690; tallow imidazolinium methosulfate (Incrosoft® S-75), and alkylimidazolinium methosulfate (Incrosof® CFI-75), both available from Croda, Inc., New York, N.Y.

Other useful amine salts are the stearyl amine salts that are soluble in water such as stearyl-dimethylamine hydrochloride, distearyl amine hydrochloride, decyl pyridinium bromide, the pyridinium chloride derivative of the acetylaminoethyl esters of lauric acid, lauryl trimethyl ammonium chloride, decylamine acetate and bis[(oleoyl)-(5,8)-ethanoloxy]-tallow ($C_1$–$C_{18}$)aminehydrogen phosphate (Necon® CPS-100) and the like.

For both anionic and cationic surfactants, it may be necessary or desirable to adjust pH levels of the composition, as someone of ordinary skill in this art would know.

D. Fabric-treatment Agents and Other Additives

In all of the embodiments of the invention, the above-described dry-cleaning compositions may further include fabric-softening agents, or other desired agents. The dry-cleaning compositions of the invention contemplate any type of fabric-treatment agent, as long as such additives do not interfere with the dispersal and spot and/or stain removal properties of the composition. The compositions may also, or in the alternative, include an agent selected from the group consisting of anti-creasing agents, anti-soil agents, bacteriostatic agents, brightening agents, bodying agents, dyes, coloring agents, fiber emollients, finishing agents, fragrances, germicides, lubricants, mildew-proofing agents, moth-proofing agents, shrinkage controllers, preservatives, fiber emollients, stain-removing agents, deodorants, insect repellents, sizing agents, and the like, and mixtures thereof. As would be understood by someone of ordinary skill in this art, total amounts of these various agents and components to be included in the dry-cleaning compositions may vary as desired and depending on the presence of other components and the desired result.

The above-described dry-cleaning compositions may further include a compound having a vapor tension of less than or equal to 4 Pa at 25° C., which is selected from the group consisting of $C_{10}$–$C_{12}$ aliphatic alcohols, $C_{10}$–$C_{13}$ aldehydes, $C_{13}$–$C_{18}$ aliphatic ketones, aromatic ketones having a musk odor and up to 18 carbon atoms, $C_8$–$C_{15}$ aliphatic esters, methyl anthranilate, methyl N-methylanthranilate, p-cresyl phenylacetate, amyl salicylate, coumarin, dihydrocoumarin, gammadecalactone, dodecalactone, undecalactone, eugenol, isoeugenol, diphenyl oxide, the methyl and ethyl ethers of naphthol, galaxolide, indole and its reaction products with hydroxycitronella, tridecene-2-nitrile, and 2-(2'-methyl-pent-2'-enyl)-5-methyl pyridine. Such compounds are described in Joulain et al., U.S. Pat. No. 4,840,792 (the entire content of which is incorporated herein by reference). As would be understood by someone of ordinary skill in this art, total amounts of these compounds to be included in the dry-cleaning compositions may vary as desired and depending on the presence of other components and the desired result.

Other optional additives for all of the embodiments of this invention are gelling agents and viscosity modifiers. When employed, the gelling agent or viscosity modifier is effective to thicken and otherwise decrease viscosity the dry-cleaning composition. Preferably, the gelling agent comprises an organic gelling agent. For instance, useful dispersing agents can include modified starches, fatty acid and acid salts and fatty alcohols. Another gelling agent is a sulphonated polystyrene known commercially as Structure 3000®, made by National Starch. When employed, the compositions will preferably contain about 0.01 to about 5% of the gelling agent or viscosity modifiers, or as desired, as would be understood by someone having ordinary skill in this art.

E. Applications of the Dry-cleaning Compositions

The dry-cleaning compositions of the invention may be applied to soiled fabric articles in any manner that does not significantly interfere with the necessary functions of the various components of the composition. Preferably, the dry-cleaning composition is present in the dry-cleaning system on a substrate. For instance, the substrate may be a sheet, a sponge, a dauber, a stick, a cube, granules or the like.

A sheet is the preferred substrate. Fabric materials useful to form the sheet (which should be flexible) are woven or, preferably, non-woven fibers that are generally adhesively or thermally bonded, although hydroentangled non-wovens work as well. Fibrous sheets having a web or corded fiber structure, or those which comprise fibrous mats in which the fibers are distributed haphazardly or in a random array can also be used. The fibers can be natural, such as wool, silk, jute, hemp, cotton, linen, sisal, or ramie; or synthetic such as rayon, cellulose ester, polyvinyl derivatives, polyolefins, polyamides or polyesters, or mixtures of natural and synthetics. Generally, any diameter or dernier of fiber is useful in the present invention. The non-woven cloth materials employed herein are not prone to tear or separate when used, for example, in an automatic dryer, due to the haphazard or random array of fibers in the non-woven material which impart excellent strength in all directions. Some examples of preferred non-woven cloth material useful as substrates in the present invention include 100% rayon sheets, known as Fabray® Nonwoven Fabric F-110 (40 gm), available from Sterns Technical Textile Co.; or 100% polypropylene sheets, known as NW-161, available from Kimberly Clark Co., Neenah, Wis.; or as #405 or #498 from Fiber Dynamics; or as Grade 10180, 10244 or 23102 from Dexter Non-Wovens Division (blended from cellulosic rayon and synthetic fibers); or as Style 778 from Speciality Textiles.

Preferably the sheets have dimensions ranging from about 3"×4" up to about 14"×16". However, the sheet must also be of a sufficient size to carry a desirable load of dry-cleaning composition. Thus, the most preferred size of sheets for use in the present invention range from about 4"×14", particularly from about 5"×12 to about 9"×10". In conjunction therewith, the preferred sheets have surface areas ranging from about 12 inches squared to about 224 inches squared, and most preferably from about 48 inches squared to about 120 inches squared.

The dry-cleaning composition of the present invention is released from the sheet, sponge, dauber, stick, cube, granules, etc. upon physical contact with the fabric articles, e.g., as when the fabric articles and the sheet, sponge, dauber, stick, cube, granules, etc. are tumbled together in the bag, preferably under heated conditions.

For instance, in one embodiment of the invention, one or more fabric articles and a suitably sized, impregnated, flexible sheet are placed into the bag, the bag is closed, and then the bag is subjected to an amount of agitation and/or heat effective to release the dry-cleaning composition from the flexible sheet upon contacting the fabric articles. The sheet "tumbles" among the fabric articles, thus dispersing the composition evenly onto them. Thus contacted, the fabric articles are cleaned, freshened or otherwise treated by the composition.

In a preferred aspect of the invention, the closed bag, containing the flexible sheet and the fabric article(s), can be placed in a rotary hot air clothes dryer to provide the effective amount of heat and/or agitation, or tumbling, usually at a temperature of about 40°–95° C., preferably at about 50°–90° C., for preselected periods of time. For example, about 15–45 minutes of tumbling are sufficient to release the dry-cleaning composition from the sheet interior surface of the bag at these temperatures and to clean or freshen the fabric articles.

In an alternative embodiment of the present method, the dry-cleaning composition may further be applied directly to the soiled fabric to be cleaned, e.g., by spraying, rolling on wet or sprinkling via dry powder, the dry-cleaning composition onto the fabric, the fabric subsequently placed into the bag, the bag sealed and rotated in a hot air clothes dryer.

Where the bag has an interior surface containing the dry-cleaning composition releasably absorbed thereinto, the spotted and/or stained sections of the fabric may be manually rubbed on the inside of the impregnated bag to pre-treat the soiled areas with the dry-cleaning compositions in order to loosen the soil. In such an embodiment of the invention, the dry cleaning composition cleans the soil from the fabric while excess moisture and the removed soil are absorbed by the interior absorptive surface of the bag.

F. Bag

It is not necessary to use the composition of the invention with a bag, but when the bag embodiment is employed, the bag should be fabricated of an essentially gas impermeable material and comprise an opening which can be reversibly closed, in order to effectively contain the liquid or vaporous dry-cleaning compositions within the confines of the sealed bag. The bags of the present invention may be formed from any flexible material which exhibits sufficient thermal stability for use in the rotary hot air dryer discussed above. In addition, it is important that the containment bag will not substantially be damaged upon exposure to conditions including a temperature effective to cause release of the dry-cleaning composition from the substrate, fabric, etc.

Preferably, the bag will be formed from non-porous plastic film, non-woven fabric, and the like. For example, the outermost layer of the bag can be formed from polyethylene, polypropylene, polyamide, nylon, or a multiple or layered complex comprising such materials. In a preferred embodiment, the bag of the present invention is formed by the co-extrusion of materials with the desired properties.

Preferably the bags suitable for use in the present invention will have dimensions ranging from about 18"×23" up to about 36"×40". The most preferred size of bag for use in the present invention range is from about 20"×28" to about 26"×30". These dimensions preferably result in the bag having a surface area in the range of about 1120 $in^2$, and most preferably from about 1120 $in^2$ to about 1560 $in^2$.

For the embodiments of the invention wherein the bag has an interior surface, and at least a portion of the interior surface has an effective amount of a dry-cleaning composition releasably absorbed thereinto, the bag may be formed as above, except that it should have interior layer capable of absorbing releasably therein a sufficient amount of the gelled or liquid dry-cleaning composition to effectively clean fabrics without significant leaking or bleeding of the composition into the interior of the bag upon storage. In order to effectively contain the vaporous dry-cleaning compositions within the interior space of the sealed bag, the bag must, of course, have an essentially gas impermeable material as its outermost layer and comprise an opening which can be reversibly closed. For example, the outermost layer of the bag can be formed from polyethylene, polypropylene, polyamide, nylon or a multiple or layered complex comprising such materials. Preferably, the innermost plastic layer will be a reticulated plastic film formed in situ, a solid granular or porous absorbent solid filled plastic film or a combination of both foamed and solids loaded plastic. Examples of such materials include, but are not limited to, polyethylene, diatomacious earth filled polyethylene. polypropylene, and other solid absorbents dispersed in film.

In this embodiment, the bag may be formed in two steps. The thermally stable outer layer of the bag is pre-formed and a non-woven fabric subsequently attached to the inside surface of the bag in a second step.

Non-woven cloth materials useful in the present invention to form the absorbent interior surface of the bag are generally adhesively or thermally bonded fibrous products laving a web or corded fiber structure, or those which comprise fibrous mats in which the fibers are distributed haphazardly or in a random array. The fibers can be natural, such as wool, silk, jute, hemp, cotton, linen, sisal, or ramie; or synthetic such as rayon, cellulose ester, polyvinyl derivatives, polyolefins, polyamides or polyesters. Generally, any diameter or dernier of fiber is useful in the present invention. The non-woven cloth materials employed herein are not prone to tear or separate when used, for example, in an automatic dryer, due to the haphazard or random array of fibers in the non-woven material which impart excellent strength in all directions. Some examples of preferred non-woven cloth material useful as substrates in the present invention include 100% rayon sheets, available as described above.

The interior surface of the bag that retains the cleaning composition may be rendered suitably absorptive by a number of means. For example, the bag may have one or more multiple layers of plastic film, the innermost film being absorptive, i.e., a reticulated plastic foam, a solid granular or porous absorbent solid filled plastic film or a combination of both foamed and solids loaded plastic. Such bags may be formed by co-extruding one or more multiple layers of plastic layers simultaneously during the blowing of the bag. In another embodiment of the invention, a single-use dry cleaning bag is provided in which the interior surface of the bag may be pre-impregnated with the dry cleaning composition. For example, in this embodiment of the invention, the interior absorptive surface may be a non-woven fabric attached to the inside surface of the bag after formation of the bag itself, as a second step. The dry-cleaning composition may be applied to the interior absorptive surface of the bag wall, i.e., by spraying, after the manufacture of the bag. Once the dry cleaning composition has been applied, the soiled fabric can be introduced into the bag, the bag fastened and tumbled in a clothes dryer.

After use, the bag may be discarded, or if desired, it may be constructed of a suitable material to allow repeated usage in a plurality of cleaning cycles.

EXAMPLES

The following examples further illustrate the present invention and preferred embodiments thereof. It is to be understood, however, that these examples are for illustrative purposes only and are not intended to limit the scope of the specification or claims thereof in any way.

Example I

Dry-Cleaning Compositions

In general, the compositions are prepared in the following manner.

In a suitable vessel equipped with stirrer or mixing device, distilled water is charged and then a desired amount of polysulfonic acid (e.g., HSP-1180) is added. The polysulfonic acid is mixed until fully dispersed uniformly. The solvent/solvents, if desired, is/are then added until dispersed. The remaining materials such as surfactants, fragrances, etc., if desired, are added individually with agitation. The system pH can be adjusted after the polysulfonic acid is added to the water or at the end of preparation.

The following are examples of different formulations of the composition of the invention. In these formulations, HSP-1180 is polysulfonic acid (from Henkel Corp.); Arcolsolv® DPNB is dipropylene glycol n-propyl ether (from Arco Chemical Co.); Arcolsolv® DPNP is dipropylene glycol t-butyl ether (from Arco Chemical Co.); Arcolsolv® is dipropylene glycol methyl ether (from Arco Chemical Co.); Tergitol® 15-S-3 is a nonionic surfactant (from Union Carbide Corp.); Igepal® CO-660 is a nonionic surfactant (from Rhone-Poulenc); and Fragr DC1212 is a fragrance (from Hagelin & Company). All ingredients are commercially available.

| Ingredients | % | % | % |
|---|---|---|---|
| Water, distilled | 99.0 | 97.0 | 95.0 |
| HSP-1180 | 1.0 | 3.0 | 5.0 |
| | 100.0 | 100.0 | 100.0 |

When these three formulations were used to remove various stains (gravy, tomato sauce, and French dressing) from fabrics made of silk, wool, rayon and wool blend dark blue suiting, it was determined that all three formulations demonstrated stain removal properties on both old and new stains, when compared to stains treated with water alone. In some instances, the stain was almost totally removed.

Table 1 describes other formulations according to the invention.

TABLE 1

| Ingredients | Polysulfonic Acid Systems | | | | | | | | |
|---|---|---|---|---|---|---|---|---|---|
| | JS-3-201A % | JS-3-201B % | JS-3-201C % | JS-3-201D % | JS-3-201E % | JS-3-202-1 % | JS-3-202-2 % | JS-3-202-3 % | JS-3-202-4 % |
| Arcosolv DPNB | 42.03 | 0.00 | 41.86 | 0.00 | 0.00 | 0.00 | 0.00 | 0.00 | 0.00 |
| Arcosolv DPNP | 0.00 | 41.86 | 0.00 | 0.00 | | 55.96 | 55.96 | 55.96 | 55.96 |
| Arcosolv TPM | 50.95 | 51.10 | 44.18 | 72.70 | 9.00 | 13.94 | 14.94 | 15.94 | 16.94 |
| Water, distilled | 2.90 | 2.91 | 8.84 | 20.00 | 83.70 | 25.00 | 25.00 | 25.00 | 25.00 |
| Tergitol 15-S-3 | 0.41 | 0.41 | 0.41 | 0.80 | 0.80 | 0.80 | 0.80 | 0.80 | 0.80 |
| Igepal CO-660 | 0.58 | 0.58 | 0.53 | 1.00 | 1.00 | 1.00 | 1.00 | 1.00 | 1.00 |
| HSP-1180 | 2.90 | 2.91 | 3.53 | 5.00 | 5.00 | 3.00 | 2.00 | 1.00 | 0.50 |
| Frag DC1212 | 0.23 | 0.23 | 0.53 | 0.50 | 0.50 | 0.50 | 0.50 | 0.50 | 0.50 |
| Total | 100.00 | 100.00 | 100.00 | 100.00 | 100.00 | 100.00 | 100.00 | 100.00 | 100.00 |

| Ingredients | Polysulfonic Acid Formulations | | | | | | | | | | | |
|---|---|---|---|---|---|---|---|---|---|---|---|---|
| | MS-119-A1 % | MS-1-119-A2 % | MS-1-119-A3 % | MS-1-119-A4 % | MS-1-119-A5 % | MS-1-119-A6 % | MS-1-119-B1 % | MS-1-119-B2 % | MS-1-119-B3 % | MS-1-119-B4 % | MS-1-119-B5 % | MS-1-119-B6 % |
| Arcosolv DPNB | 69.7 | 59.7 | 49.7 | 39.7 | 29.7 | 19.7 | 0.0 | 0.0 | 0.0 | 0.0 | 0.0 | 0.0 |
| Arcosolv DPNP | 0.0 | 0.0 | 0.0 | 0.0 | 0.0 | 0.0 | 69.7 | 59.7 | 49.7 | 39.7 | 29.7 | 19.7 |
| Water distilled | 25.0 | 35.0 | 45.0 | 55.0 | 65.0 | 75.0 | 25.0 | 35.0 | 45.0 | 55.0 | 65.0 | 75.0 |
| HSP-1180 | 3.0 | 3.0 | 3.0 | 3.0 | 3.0 | 3.0 | 3.0 | 3.0 | 3.0 | 3.0 | 3.0 | 3.0 |
| Tergitol 15-S-3 | 0.8 | 0.8 | 0.8 | 0.8 | 0.8 | 0.8 | 0.8 | 0.8 | 0.8 | 0.8 | 0.8 | 0.8 |
| Igepal CO-660 | 1.0 | 1.0 | 1.0 | 1.0 | 1.0 | 1.0 | 1.0 | 1.0 | 1.0 | 1.0 | 1.0 | 1.0 |
| Fragr DC1212 | 0.5 | 0.5 | 0.5 | 0.5 | 0.5 | 0.5 | 0.5 | 0.5 | 0.5 | 0.5 | 0.5 | 0.5 |
| Total | 100.0 | 100.0 | 100.0 | 100.0 | 100.0 | 100.0 | 100.0 | 100.0 | 100.0 | 100.0 | 100.0 | 100.0 |

TABLE 1-continued

| | Polysulfonic Acid Formulations | | | | | | | | | |
|---|---|---|---|---|---|---|---|---|---|---|
| | MS-1-116-1 | MS-1-116-2 | MS-1-116-3 | MS-1-1164 | MS-1-116-5 | MS-1-116-6 | MS-1-116-7 | MS-1-116-8 | MS-1-116-9 | MS-1-116-10 |
| Ingredients | % | % | % | % | % | % | % | % | % | % |
| Arcosolv TPM | 67.7 | 62.7 | 57.7 | 52.7 | 47.7 | 42.7 | 37.7 | 32.7 | 27.7 | 22.7 |
| Water, distilled | 25.0 | 30.0 | 35.0 | 40.0 | 45.0 | 50.0 | 55.0 | 60.0 | 65.0 | 70.0 |
| HSP-1180 | 5.0 | 5.0 | 5.0 | 5.0 | 5.0 | 5.0 | 5.0 | 5.0 | 5.0 | 5.0 |
| Tergitol 15-S-3 | 0.8 | 0.8 | 0.8 | 0.8 | 0.8 | 0.8 | 0.8 | 0.8 | 0.8 | 0.8 |
| Igepal CO-860 | 1.0 | 1.0 | 1.0 | 1.0 | 1.0 | 1.0 | 1.0 | 1.0 | 1.0 | 1.0 |
| Fragr DC1212 | 0.5 | 0.5 | 0.5 | 0.5 | 0.5 | 0.5 | 0.5 | 0.5 | 0.5 | 0.5 |
| Total | 100.0 | 100.0 | 100.0 | 100.0 | 100.0 | 100.0 | 100.0 | 100.0 | 100.0 | 100.0 |

| | Polysulfonic Acid Formulations | | | |
|---|---|---|---|---|
| Ingredients | JS-3-202-1 % | JS-3-202-2 % | JS-3-202-3 % | JS-3-202-4 % |
| Arcosolv TPM | 13.9 | 14.9 | 15.9 | 16.4 |
| Arcosolv DPNP | 56.0 | 56.0 | 56.0 | 56.0 |
| Water, distilled | 25.0 | 25.0 | 25.0 | 25.0 |
| HSP-1180 | 3.0 | 2.0 | 1.0 | 0.5 |
| Tergitol 15-S-3 | 0.8 | 0.8 | 0.8 | 0.8 |
| Igepal CO-660 | 1.0 | 1.0 | 1.0 | 1.0 |
| Fragr DC1212 | 0.5 | 0.5 | 0.5 | 0.5 |
| Total | 100.0 | 100.0 | 100.0 | 100.0 |

The following Tables 2 and 3 show a sampling of the results obtained when the above formulations were used to remove various stains from various fabrics.

The formulations were tested in a stain removal procedure conducted as follows. Stains approximately the size of a dime were placed on each fabric and left to dry for 24–48 hours. Stains including spaghetti and gravy do not fully absorb into fabric so after drying they were gently scraped to remove the excess stain. As close as possible each stain was removed with the same procedure, as follows.

A clean paper towel was placed under the stain on the cloth swatch. Then the cloth swatch was subjected to 10 seconds rubbing with the paper towel. Then the cloth swatch was moved to a clean spot on the paper towel, and subjected to 20 seconds further rubbing. Then, again, the cloth swatch was moved to a clean spot on the paper towel, and subjected to another 20 seconds further rubbing. The cloth swatch was put aside to air dry.

All cloth swatches were taken from fabrics supplied by Testfabrics, Inc. The following swatches were used.

(1) Spun viscose challis (regenerated cellulose/rayon, weight 138 gm/M) (abbreviated as "Rayon #266")

(2) Silk charmeuse 20 mm (weight 90 gm/M) (abbreviated as "Silk #608")

(3) 100% worsted flannel (oil less than ½%, weight 241 gm/M) (abbreviated as "Wool #526)

The stain types were as follows:

(1) Wishbone Deluxe French dressing (abbreviated as "Fr.Dressing")

(2) Estee Lauder lipstick, color "Perfect Raspberry #24" (abbreviated as "Lipstick")

(3) Ship Rite spaghetti sauce, meatless (abbreviated as "Spaghetti").

By "% stain removal", it is meant the percentage stain removal is determined by eye. A rating of 100% stain removal means no visual sign of the original stain remains on the fabric, while 0% stain removal would be a stained cloth that was never spot cleaned.

By "Overall Rating", it is meant a visual observation of how the cloth looks after the stain has been removed and the cloth is air dried for at least 24 hours. The rating is based on a 0–5 scale, where 5=excellent, 3=good, 1=poor, and 0=very poor).

By "Rank Order", it is meant that, within as given set of test swatches, swatches are placed in order from best to worst for overall visual appearance. There can be no "ties".

The results indicated in Tables 2 and 3 are only a sampling of the results obtained in testing the formulations described in Table 1. It is noted that all the formulations in Table 1 when tested demonstrated effectiveness in removing stains and dry-cleaning the cloth swatches.

TABLE 2

| Sample | Fabric Type | Stain Type | % Stain Removal | Overall Rating | Rank Order | Rank Out of |
|---|---|---|---|---|---|---|
| JS-3-202-1 | Wool #526 | Fr. Dressing | 93 | 2.7 | 1.0 | 2 |
| JS-3-202-3 | Wool #526 | Lipstick | 98 | 3 | 2.0 | 2 |
| JS-3-202-1 | Wool #526 | Lipstick | 99 | 3.3 | 1.0 | 2 |
| JS-3-202-3 | Silk #608 | Lipstick | 100 | 2.7 | 1.3 | 2 |
| JS-3-202-1 | Silk #608 | Lipstick | 97 | 2.3 | 1.7 | 2 |
| JS-3-201E | Wool #526 | Lipstick | 97 | 3.7 | 3.0 | 4 |
| JS-3-201D | Wool #526 | Lipstick | 95 | 2.7 | 4.0 | 4 |
| JS-3-201B | Wool #526 | Lipstick | 100 | 5.0 | 2.0 | 4 |
| JS-3-201A | Wool #526 | Lipstick | 100 | 5.0 | 1.0 | 4 |
| JS-3-201D | Wool #526 | Spaghetti | 90 | 3.0 | 1.0 | 4 |
| JS-3-201D | Wool #526 | Fr. Dressing | 93 | 3.0 | 1.0 | 4 |
| JS-3-201D | Silk #608 | Lipstick | 100 | 4.3 | 3.0 | 4 |
| JS-3-201B | Silk #608 | Lipstick | 100 | 4.7 | 2.0 | 4 |
| JS-3-201A | Silk #608 | Lipstick | 100 | 4.7 | 1.0 | 4 |
| JS-3-201E | Silk #608 | Fr. Dressing | 100 | 1.3 | 1.7 | 4 |
| JS-3-201D | Rayon #266 | Lipstick | 95 | 3.3 | 3.0 | 4 |
| JS-3-201B | Rayon #266 | Lipstick | 100 | 5.0 | 2.0 | 4 |
| JS-3-201A | Rayon #266 | Lipstick | 100 | 5.0 | 1.0 | 4 |
| JS-3-201E | Rayon #266 | Fr. Dressing | 93 | 2.0 | 1.0 | 4 |
| JS-3-202-3 | Rayon #266 | Fr. Dressing | 90 | 3.0 | 1.0 | 4 |
| JS-3-202-3 | Wool #526 | Lipstick | 98 | 4.3 | 1.0 | 4 |
| JS-3-202-3 | Wool #526 | Fr. Dressing | 92 | 3.3 | 1.0 | 4 |
| MS-1-116-6 | Wool #526 | Spaghetti | 94 | 2.7 | 1.0 | 4 |
| MS-1-119-B5 | Wool #526 | Lipstick | 95 | 3.7 | 3.3 | 4 |
| MS-1-119-B2 | Wool #526 | Lipstick | 100 | 4.3 | 1.3 | 4 |
| MS-1-119-A5 | Wool #526 | Lipstick | 95 | 3.3 | 3.7 | 4 |
| MS-1-119-A2 | Wool #526 | Lipstick | 100 | 4.7 | 1.7 | 4 |
| MS-1-119-B5 | Wool #526 | Fr. Dressing | 92 | 3.0 | 4.0 | 4 |
| MS-1-119-B2 | Wool #526 | Fr. Dressing | 96 | 4.0 | 2.3 | 4 |
| MS-1-119-A5 | Wool #526 | Fr. Dressing | 100 | 4.0 | 2.0 | 4 |
| MS-1-119-A2 | Wool #526 | Fr. Dressing | 98 | 3.7 | 1.7 | 4 |
| MS-1-119-B5 | Wool #526 | Spaghetti | 92 | 4.0 | 2.0 | 4 |
| MS-1-119-AS | Wool #526 | Spaghetti | 98 | 4.3 | 1.7 | 1 |

TABLE 3

| | Stain Removal/% Removal versus Typical Control | | | | | | | | |
|---|---|---|---|---|---|---|---|---|---|
| | 100% Worsted FlannelWool #526 | | | Silk Charmeuse 20 mm #608 | | | Spun Viscose Challis Rayon #266 | | |
| Formulation | Spaghetti % Removal | Lipstick % Removal | French Dress % Removal | Spaghetti % Removal | Lipstick % Removal | French Dress % Removal | Spaghetti % Removal | Lipstick % Removal | French Dress % Removal |
| JS-3-201D | 90 | 95 | 93 | 55 | 100 | 75 | 8 | 95 | 65 |
| MS-1-116-2 | 83 | 57 | 75 | 43 | 67 | 78 | 23 | 62 | 82 |
| MS-1-116-6 | 94 | 38 | 80 | 57 | 37 | 82 | 50 | 33 | 73 |
| MS-1-119-A2 | 79 | 100 | 98 | 50 | 72 | 82 | N/A | N/A | N/A |
| MS-1-119-A5 | 98 | 95 | 100 | 53 | 60 | 86 | N/A | N/A | N/A |
| MS-1-119-B5 | 92 | 95 | 92 | 62 | 88 | 92 | N/A | N/A | N/A |
| Control | 87 | 96 | 100 | 73 | 95 | 97 | 67 | 81 | 81 |

Example III

Application of the Dry-Cleaning Composition

The mixture of Examples I or II can be coated warm or cool or room temperature onto a substrate by means of a Meyer rod, a floating knife or doctor blade. Alternatively, the substrate can be dipped into the liquid mixture or the mixture can be sprayed or sponged onto the substrate and then allowed to thicken. The mixture remains moist on the substrate. For example, the substrate can be placed on a level surface, such as on a glass plate. The dry-cleaning reaction mixture is poured across the top of the substrate and a metal rod is drawn down the surface of the substrate, which will drive the mixture through a porous substrate. Therefore, the substrate is both impregnated with and overcoated with the dry-cleaning composition.

The finished substrates (e.g., flexible sheets, sponges, cubes, sticks, granules, daubers, etc.) on which the dry-cleaning composition is applied are preferably packaged in moisture impermeable packaging, e.g., in foil, a foil-plastic film or a foil-treated paper composite envelope.

Example IV

Application of the Dry-Cleaning Composition

The dry-cleaning composition of Example I or II can be applied onto the inner absorptive surface of the bag, as by spraying, sponging or other known methods of application and then allowed to absorb into the surface.

For the embodiments of the invention wherein the bag has an interior surface, and at least a portion of the interior surface has an effective amount of a dry-cleaning composition releasably absorbed thereinto, the dry-cleaning composition may be impregnated into the inner surface of the bag during manufacturing. This embodiment of the invention provides a single use dry cleaning bag. If impregnated, the impregnation step would be achieved, for example, by spraying the dry-cleaning composition onto the absorptive inner surface of the bag during the 'cool-down' step of manufacturing, i.e., that step when air is pumped into the bag to cool it after extrusion. The dry-cleaning composition may further be applied directly to the soiled fabric to be cleaned, i.e., by spraying, sponging or dipping, prior to introducing the fabric into the bag.

Following a cooling period, the finished dry-cleaning bags are preferably packaged in moisture impermeable packaging, e.g., in foil, a foil-plastic film or a foil-treated paper composite envelope.

The invention has been described with reference to various specific and preferred embodiments and techniques. However, it should be understood that many variations and modifications may be made while remaining within the spirit and scope of the invention.

What is claimed is:

1. A dry-cleaning and/or fabric-freshening system comprising (a) a dry-cleaning and/or fabric-freshening composition comprising polysulfonic acid and water; and (b) a bag formed of vapor impermeable material and including an opening comprising a fastening system.

2. The dry-cleaning and/or fabric freshening system of claim 1, wherein the bag has an interior surface, and at least a portion of the interior surface has an effective amount of the dry-cleaning and/or fabric-freshening composition releasably absorbed thereinto, wherein the bag is formed of a flexible non-porous material which is not substantially damaged upon exposure to agitation and to a temperature effective to cause the release of the dry-cleaning and/or fabric freshening composition from the interior surface.

3. A process for cleaning or freshening a soiled fabric article with a dry-cleaning and/or fabric-freshening composition, the process comprising:

(a) placing into a bag the soiled fabric article and an effective amount of a dry-cleaning and/or fabric-freshening composition comprising polysulfonic acid and water;

wherein the bag is formed of vapor impermeable material and includes an opening comprising a fastening system;

(b) closing the fastening system;

(c) tumbling the bag in a rotary clothes dryer at an elevated temperature, so that the dry-cleaning and/or fabric-freshening composition contacts the soiled fabric article within the bag so as to effectively disperse the soil; and (d) opening the fastening system and removing the cleaned or freshened fabric article from the bag.

4. The process of claim 3, wherein the dry-cleaning and/or fabric freshening composition is present on a substrate.

5. The process of claim 4, wherein the substrate is selected from the group consisting of a sheet, a sponge, a dauber, a stick, granules and a cube.

6. The process of claim 5, wherein the substrate is a sheet.

7. The process of claim 3, wherein the dry-cleaning and/or fabric-freshening composition contains between about 0.25 and about 20 weight percent polysulfonic acid.

8. The process of claim 3, wherein the dry-cleaning and/or fabric-freshening composition contains between about 10 and about 99.75 weight percent water.

9. The process of claim 3, wherein the dry-cleaning and/or fabric-freshening composition further comprises at least one water-miscible or partially water-miscible organic solvent.

10. The process of claim 9, wherein the organic solvent is selected from the group consisting of glycol ethers, liquid polyethylene glycols, $C_2$–$C_4$ polyols, lactones and mixtures thereof.

11. The process of claim 9, wherein the organic solvent is selected from the group consisting of dipropylene glycol n-propyl ether, dipropylene glycol n-butyl ether, tripropylene glycol methyl ether, 3-methoxy-3-methyl-1-butanol and γ-butyrolactone.

12. The process of claim 9, wherein the dry-cleaning and/or fabric-freshening composition contains between about 1 and about 85 weight percent of the organic solvent.

13. The process of claim 3, wherein the dry-cleaning and/or fabric-freshening composition further includes surfactants.

14. The process of claim 13, wherein the surfactants are present in the dry-cleaning and/or fabric-freshening composition in an amount between about 0.01 and about 10 weight percent.

15. The process of claim 3, wherein the dry-cleaning composition further includes gelling agents or viscosity modifiers.

16. The process of claim 3, wherein the dry-cleaning and/or fabric-freshening composition further includes an agent selected from the group consisting of fabric-softening agents, anti-creasing agents, anti-soil agents, bacteriostatic agents, brightening agents, bodying agents, dyes, fiber emollients, finishing agents, fragrances, germicides, lubricants, mildew-proofing agents, moth-proofing agents, shrinkage controllers, sizing agents, and mixtures thereof.

17. The process of claim 3, wherein the dry-cleaning and/or fabric-freshening composition further includes a compound having a vapor tension of less than or equal to 4 Pa at 25° C., which is selected from the group consisting of $C_{10}$–$C_{12}$ aliphatic alcohols, $C_{10}$–$C_{13}$ aldehydes, $C_{13}$–$C_{18}$ aliphatic ketones, aromatic ketones having a musk odor and up to 18 carbon atoms, $C_8$–$C_{15}$ aliphatic esters, methyl anthranilate, methyl N-methylanthranilate, p-cresyl phenylacetate, amyl salicylate, coumarin, dihydrocoumarin, gammadecalactone, dodecalactone, undecalactone, eugenol, isoeugenol, diphenyl oxide, the methyl and ethyl ethers of naphthol, galaxolide, indole and its reaction products with hydroxycitronella, tridecene-2-nitrile, and 2-(2'-methylpent-2'-enyl)-5-methyl pyridine.

18. The process of claim 17, wherein the amount of the compound present in the dry-cleaning and/or fabric-freshening composition is between about 0.2% to about 5%.

19. The process of claim 3, wherein the dry-cleaning and/or fabric-freshening composition is present in a spray or roll on solution.

20. The process of claim 3, wherein the bag has an interior surface, and at least a portion of the interior surface has an effective amount of the dry-cleaning and/or fabric-freshening composition releasably absorbed thereinto, wherein the bag is formed of a flexible non-porous material which is not substantially damaged upon exposure to agitation and to a temperature effective to cause the release of the dry-cleaning and/or fabric-freshening composition from the interior surface.

21. A method for removing a stain from a soiled fabric article, the method comprising the steps of:

(a) placing into a bag the soiled fabric article and an effective amount of a dry-cleaning and/or fabric-freshening composition comprising polysulfonic acid and water;

wherein the bag is formed of vapor impermeable material and includes an opening comprising a fastening system;

(b) closing the fastening system;

(c) tumbling the bag in a rotary clothes dryer at an elevated temperature, so that the dry-cleaning and/or fabric-freshening composition contacts the soiled fabric article within the bag so as to effectively disperse the stain; and (d) opening the fastening system and removing the cleaned fabric article from the bag.

22. The method of claim 21 wherein, prior to step (a), an amount of the dry-cleaning and/or fabric freshening composition is applied to the soiled fabric article to loosen the stain.

23. The method of claim 22, wherein the amount of dry-cleaning and/or fabric-freshening composition prior to step (a) is applied by rubbing or dabbing the soiled fabric article with the dry-cleaning and/or fabric-freshening composition so as to loosen and remove stain from the soiled fabric article.

24. The method of claim 22, wherein the amount of dry-cleaning and/or fabric-freshening composition prior to step (a) is applied either by spraying, rolling on or dipping the soiled fabric article with the dry cleaning and/or fabric-freshening composition.

25. A kit for dry-cleaning or fabric-freshening a fabric article, comprising:

(i) a dry-cleaning and/or fabric-freshening composition comprising polysulfonic acid and water; and (ii) a bag formed of a vapor impermeable material and including an opening comprising a fastening system.

26. A method for cleaning and/or freshening a fabric article comprising the step of contacting the fabric article with an effective amount of a dry-cleaning and/or fabric-freshening composition comprising polysulfonic acid and water, under such conditions that the fabric article is cleaned and/or freshened.

27. The method of claim 26, wherein the dry-cleaning and/or fabric-freshening composition comprises between about 0.25 and about 20 weight percent polysulfonic acid.

28. The method of claim 26, wherein the dry-cleaning and/or fabric-freshening composition comprises between about 10 and about 99.75 weight percent water.

29. The method of claim 26, wherein the dry-cleaning and/or fabric-freshening composition further comprises at least one water-miscible or partially water-miscible organic solvent.

30. The method of claim 29, wherein the organic solvent is selected from the group consisting of glycol ethers, liquid polyethylene glycols, $C_2$–$C_4$ polyols, lactones and mixtures thereof.

31. The method of claim 29, wherein the organic solvent is selected from the group consisting of dipropylene glycol n-propyl ether, dipropylene glycol n-butyl ether, tripropylene glycol methyl ether, 3-methoxy-3-methyl-1-butanol and γ-butyrolactone.

32. The method of claim 29, wherein the dry-cleaning and/or fabric-freshening composition comprises between about 1 and about 85 weight percent of the organic solvent.

33. The method of claim 26, wherein the dry-cleaning and/or fabric-freshening composition further comprises a surfactant.

34. The method of claim 33, wherein the surfactant is present in the dry-cleaning and/or fabric-freshening composition in an amount between about 0.01 and about 10 weight percent.

35. The method of claim 26, wherein the dry-cleaning composition and/or fabric-freshening further comprises gelling agents or viscosity modifiers.

36. The method of claim 26, wherein the dry-cleaning and/or fabric-freshening composition further comprises an agent selected from the group consisting of fabric-softening agents, anti-creasing agents, anti-soil agents, bacteriostatic agents, brightening agents, bodying agents, dyes, fiber emollients, finishing agents, fragrances, germicides, lubricants, mildew-proofing agents, moth-proofing agents, shrinkage controllers, sizing agents, and mixtures thereof.

37. The method of claim 26, wherein the dry-cleaning and/or fabric-freshening composition further comprises a compound having a vapor tension of less than or equal to 4 Pa at 25° C., which is selected from the group consisting of $C_{10}$–$C_{12}$ aliphatic alcohols, $C_{10}$–$C_{13}$ aldehydes, $C_{13}$–$C_{18}$ aliphatic ketones, aromatic ketones having a musk odor and up to 18 carbon atoms, $C_8$–$C_{15}$ aliphatic esters, methyl anthranilate, methyl N-methylanthranilate, p-cresyl phenylacetate, amyl salicylate, coumarin, dihydrocoumarin, gammadecalactone, dodecalactone, undecalactone, eugenol, isoeugenol, diphenyl oxide, the methyl and ethyl ethers of naphthol, galaxolide, indole and its reaction products with hydroxycitronella, tridecene-2-nitrile, and 2-(2'-methyl-pent-2'-enyl)-5-methyl pyridine.

38. The method of claim 37, wherein the amount of the compound present in the dry-cleaning and/or fabric-freshening composition is between about 0.2 to about 5 weight percent.

39. The method of claim 26, wherein the dry-cleaning and/or fabric-freshening composition is present on a substrate.

40. The method of claim 39, wherein the substrate is selected from the group consisting of a sheet, a sponge, a dauber, a stick, granules and a cube.

41. The method of claim 39, wherein the substrate is a sheet.

42. The method of claim 26, wherein the dry-cleaning and/or fabric-freshening composition is present in a spray or roll on solution.

* * * * *